US010493591B1

(12) United States Patent
Kunkel et al.

(10) Patent No.: US 10,493,591 B1
(45) Date of Patent: Dec. 3, 2019

(54) LAPPING SYSTEM INCLUDING ONE OR MORE LASERS, AND RELATED METHODS

(71) Applicant: Seagate Technology LLC, Cupertino, CA (US)

(72) Inventors: Gary J. Kunkel, Minneapolis, MN (US); Zoran Jandric, St. Louis Park, MN (US); Andrew Habermas, Bloomington, MN (US)

(73) Assignee: Seagate Technology LLC, Cupertino, CA (US)

( * ) Notice: Subject to any disclaimer, the term of this patent is extended or adjusted under 35 U.S.C. 154(b) by 83 days.

(21) Appl. No.: 15/807,249

(22) Filed: Nov. 8, 2017

Related U.S. Application Data

(60) Provisional application No. 62/419,773, filed on Nov. 9, 2016.

(51) Int. Cl.
*B24B 49/12* (2006.01)
*B24B 37/04* (2012.01)

(52) U.S. Cl.
CPC ..... *B24B 37/048* (2013.01)

(58) Field of Classification Search
CPC ..... B24B 1/00; B24B 9/12; B24B 49/10
USPC ..... 451/5, 6, 28, 7, 53; 29/603.16, 603.15
See application file for complete search history.

(56) References Cited

U.S. PATENT DOCUMENTS

| | | | | |
|---|---|---|---|---|
| 6,123,608 | A * | 9/2000 | Nakagawa | B24B 37/30 29/603.17 |
| 6,627,909 | B2 * | 9/2003 | Khlif | G11B 5/6005 250/548 |
| 6,831,249 | B2 * | 12/2004 | Tam | B21D 11/20 219/121.69 |
| 6,857,937 | B2 | 2/2005 | Bajorek | |
| 7,086,931 | B2 * | 8/2006 | Oyama | G11B 5/31 29/603.07 |
| 8,208,350 | B1 | 6/2012 | Hu et al. | |
| 8,456,969 | B1 | 6/2013 | Mooney et al. | |
| 8,501,536 | B2 | 8/2013 | Mooney et al. | |
| 2002/0155794 | A1 * | 10/2002 | Fatula, Jr. | B24B 37/048 451/53 |

* cited by examiner

*Primary Examiner* — Robert A Rose
(74) *Attorney, Agent, or Firm* — Kagan Binder, PLLC

(57) ABSTRACT

Embodiments of the present disclosure include methods and systems of lapping a row bar of sliders, where the systems and methods use externally mounted laser components to focus laser energy on an area of an individual slider that can absorb the laser energy in a manner to cause at least the write pole and/or reader to protrude more relative to one or more other slider components (e.g., a reader) during lapping.

20 Claims, 11 Drawing Sheets

LAPPING SYSTEM INCLUDING ONE OR MORE LASERS, AND RELATED METHODS

RELATED APPLICATION

The present Application claims priority to U.S. provisional patent application having application No. 62/419,773, filed on Nov. 9, 2016, which provisional application is incorporated herein by reference in its entirety.

BACKGROUND

The present disclosure relates to systems and methods of lapping a slider and/or row bar of sliders that can ultimately be used in a hard disc drive for read/write operations.

SUMMARY

The present disclosure includes embodiments of a lapping system that includes:

a) a mounting structure that can removably couple a row bar that includes a plurality of slider bodies, wherein each slider body has an air bearing surface having a transducer region, wherein the transducer region includes a write pole and a reader;

b) a lapping plate having a lapping surface that is operable to rotate and contact the row bar for lapping the write pole and the reader of each slider body; and c) one or more laser components, wherein each laser component is positioned to direct laser energy, when energized, to an area of one or more slider bodies to cause at least the write pole and/or reader to protrude toward the lapping surface during at least a portion of the lapping.

The present disclosure includes embodiments of a method of lapping, where the method includes:

a) providing a row bar that includes a plurality of slider bodies, wherein each slider body has an air bearing surface having a transducer region, wherein the transducer region includes a write pole and a reader;

b) lapping the row bar with a lapping surface of a rotating lapping plate to lap the write pole and the reader of each slider body; and c) during at least a portion of the lapping, directing laser energy to an area of at least one slider body to cause at least the write pole and/or reader to protrude toward the lapping surface during lapping.

DETAILED DESCRIPTION

Figure 1:
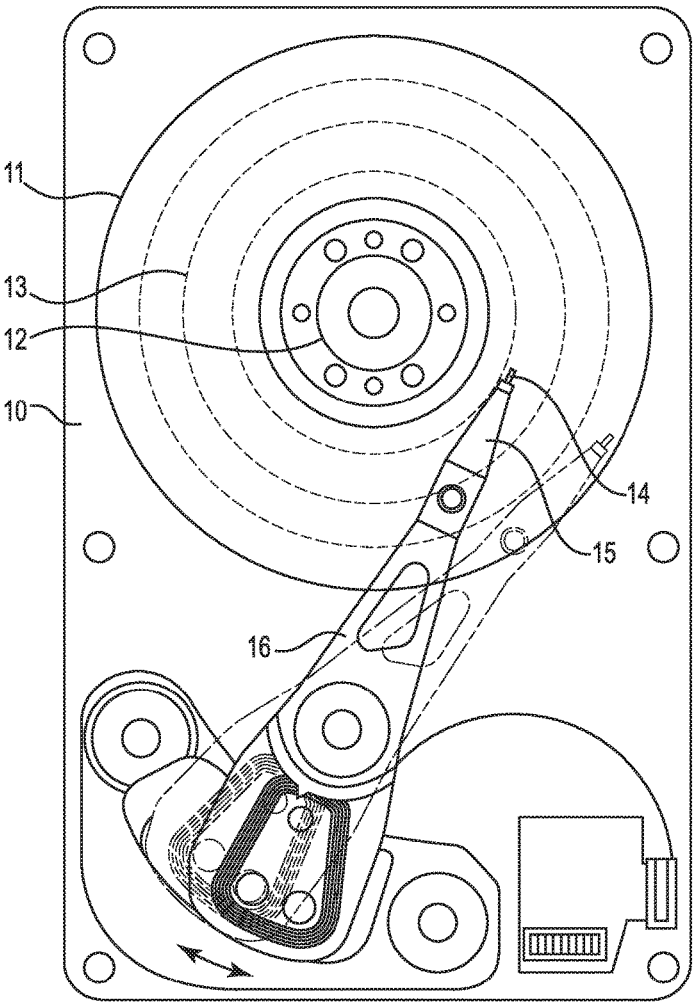
FIG. 1 shows a top view of a hard disc drive with the cover removed.

A magnetic recording apparatus is shown in FIG. 1. The apparatus 10 can be referred to as a hard disk drive (HDD) and includes a slider 14 that flies above a disk 11 by using air as a lubricant (an "air bearing"). Referring to FIG. 1, a disk 11 is placed on a spindle motor 12 that can rotate and a negative pressure air-lubricated bearing slider 14 is attached at a suspension 15 to correspond to the magnetic disk 11. The negative pressure air-lubricated bearing slider 14 can be moved (as indicated by the arrow and dashed lines) by an actuator 16 which pivots so that the slider 14 moves to a desired position on a track 13 of the disk 11. As shown, the disk 11 used as a recording medium has a circular shape and different information can be recorded on each track 13. In general, to obtain desired information, the slider 14 moves in search of a corresponding track on the disk 11. Disk 11 can have a magnetic layer that is susceptible to physical and/or chemical damage. To help mitigate such damage, such a disc often has a coating such as Diamond-like Carbon (DLC) as an overcoat to help protect the magnetic layer from physically and/or chemically induced damage.

Figure 2:
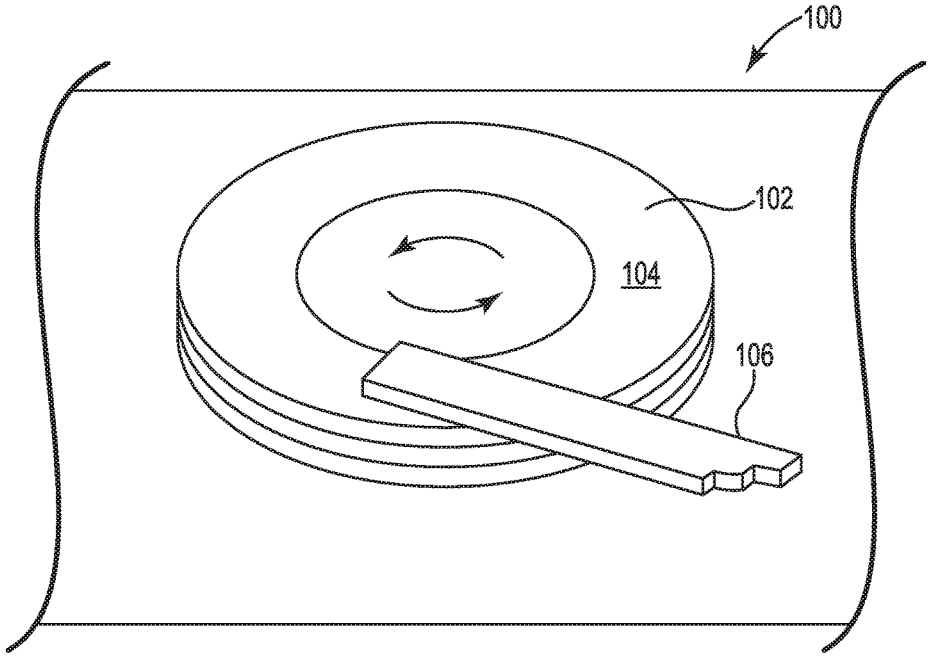
FIG. 2 is a schematic perspective view showing a lapping plate in a portion of a lapping tool.

FIG. 2 diagrammatically depicts a lapping tool 100 used for machining a surface of a row bar that can be later sliced into a plurality of individual sliders such as slider 14. The tool 100 has a rotating lapping plate 102 defining a lapping surface 104 which can help abrade the surface of a slider. If desired, a slurry can be applied to the lapping surface 104 to enhance the abrading action as the lapping surface 104 is rotated relative to a row bar 106 containing a plurality of the sliders held in a pressing engagement against the lapping surface 104. Lapping a row bar of sliders permits multiple slider bodies to be processed together, which can advantageously be relatively simple, precise and/or cost-effective. Lapping can involve multiple lapping steps such as rough lapping, final (kiss) lapping, and the like. At a desired point in manufacturing, individual sliders can be sliced from the row bar and ultimately used in a hard disk drive.

FIG. 3 illustrates an embodiment of a lapping system according to the present disclosure. As shown in FIG. 3, system 300 includes a mounting structure 305 that can removably couple a row bar 310. As shown in FIG. 3, mounting structure 305 includes an arm structure 306 and a carrier 307 removably attached to the arm structure 306. The row bar 310 can be removably attached to the carrier 307. A wide variety of techniques can be used to removably attach the row bar 310 to the carrier 307. In some embodiments, an adhesive (a rigid adhesive or a flexible adhesive) can be used to removably attach the row bar 310 to the carrier 307.

Row bar 310 includes a plurality of slider bodies 311, where each slider body 311 has an air bearing surface 312 having a transducer region 313. As shown, the transducer region 313 includes at least one write pole 314 and at least one reader 315. An example of a transducer region is described in U.S. Pat. No. 8,456,969 (Mooney et al.) and U.S. Pat. No. 8,861,316 (Yin et al.), wherein the entirety of each patent is incorporated herein by reference. A write pole and reader can be made out of magnetic material such as a cobalt iron (CoFe) alloy.

Figure 3A:
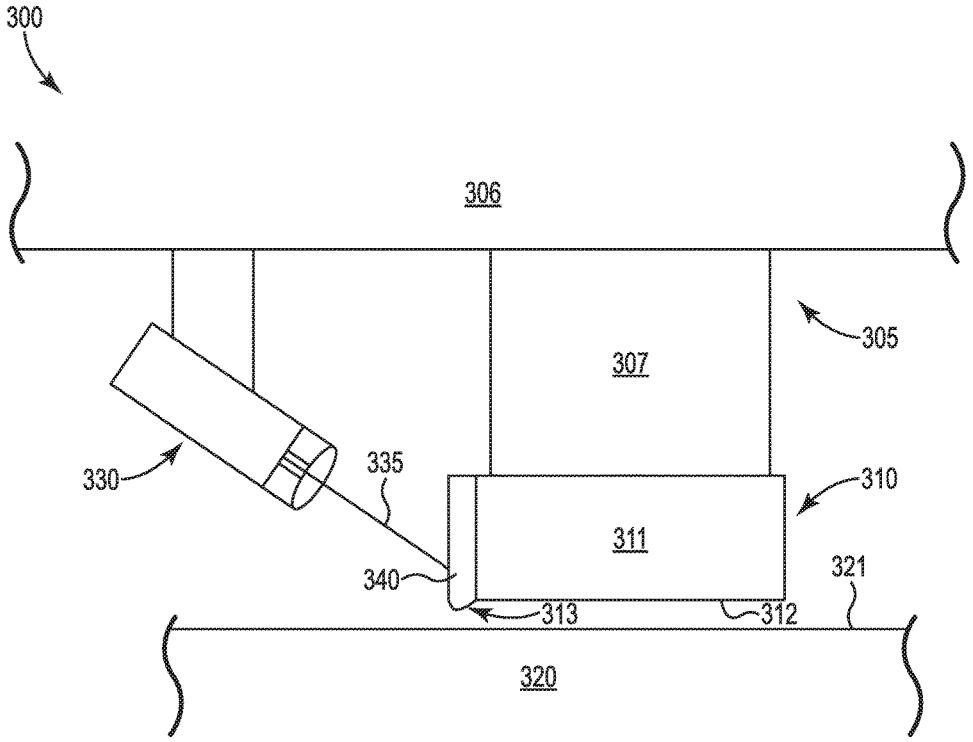
FIG. 3A is a schematic, partial, side, elevation view of a lapping system according to an embodiment of the present disclosure.
Figure 3B:
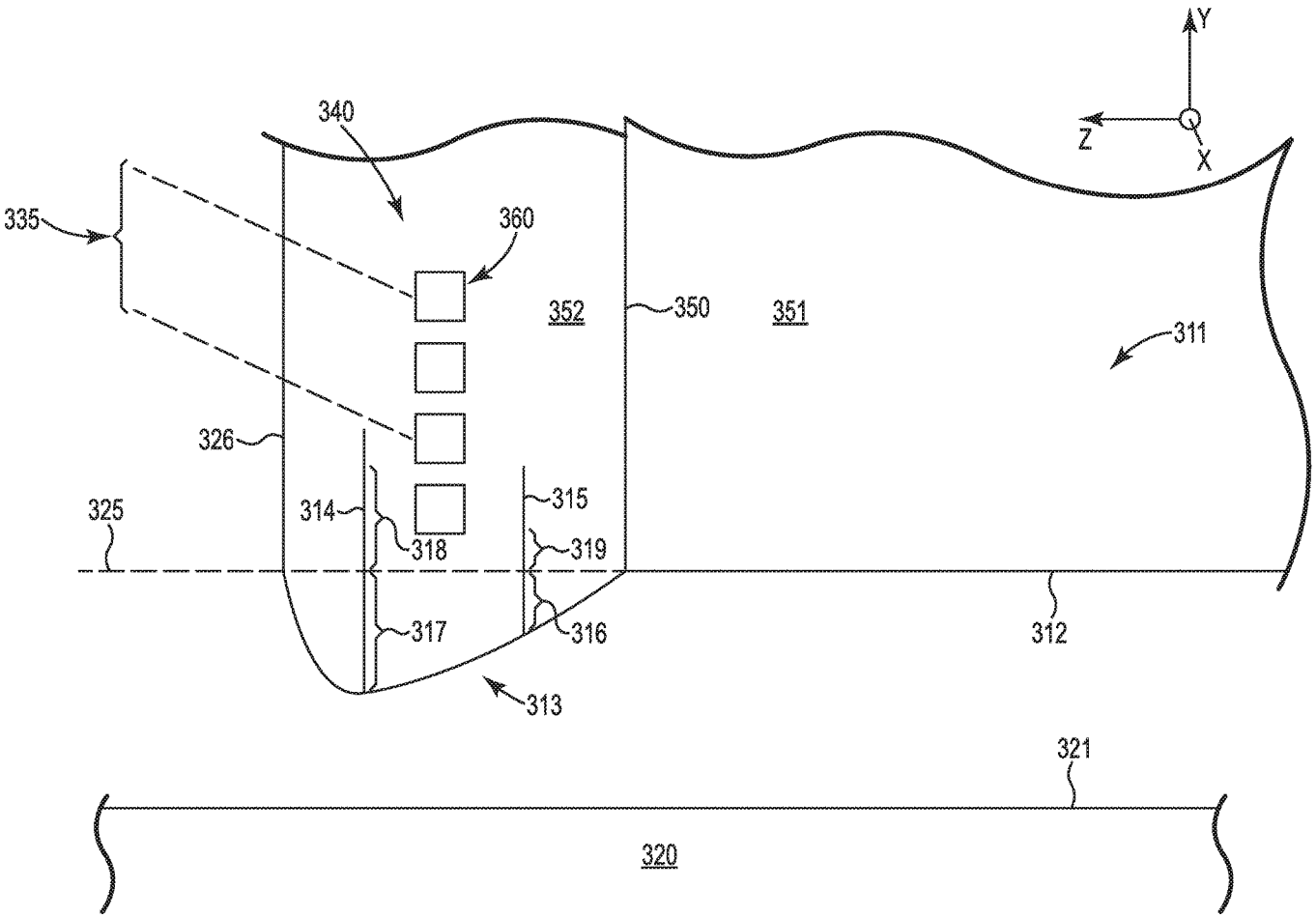
FIG. 3B is an enlarged portion of the system shown in FIG. 3A.

As shown in FIG. 3B, transducer region 313 also includes a coil structure 360, which can be made out of a conductive material. When electric current is caused to flow through conductive coil structure 360, a magnetic field can be induced in write pole 314. Coil structure 360 can be made out of a variety of conductive materials such as metal.

In some embodiments, a row bar according to the present disclosure can include at least 30 slider bodies, at least 60 slider bodies, or even at least 70 slider bodies. A slider body according to the present disclosure can be mostly made out of ceramic material. As shown in FIGS. 3A and 3B, each slider body 311 includes an "AlTiC break" 350. To the right of break 350, the bulk of the material is a two phase mixture of alumina and titanium-carbide (also referred to as AlTiC). To the left of break 350, the bulk of the material is alumina.

System 300 also includes a lapping plate 320 having a lapping surface 321 that is operable to rotate and contact the row bar 310 for lapping the write pole 314 and the reader 315 of each slider body 311.

Lapping is a material removal process used in slider manufacturing to define the air-bearing surface. Readers that are underlapped or overlapped can impact stability, error rate, and/or amplitude issues. Writers that are underlapped or overlapped can impact write field strength and write field gradient which can impact areal density and write-plus-erase yield.

Lapping to write break-point (WBP) target and reader stripe-height (RSH) target for each slider simultaneously can be challenging, if not impossible. For example, in some embodiments tilting a row bar of sliders can be the only degree of freedom, which can only control the average WBP/RSH for a row bar of sliders. Mechanical twisting of a row bar of sliders tends to not significantly control individual slider WBP/RSH targeting without undue impact to slider flatness requirements. While lapping systems can adjust the bar-averaged (reader-to-writer) tilt setting, it can be difficult, if not impossible, to correct or adjust for within-bar (reader-to-writer) tilt. For example, in some embodiments, lapping can be include a one-sided-lap (OSL) and an actuated kiss lap (AKL). From a material removal perspective, OSL can remove the bulk of material while AKL can remove a small amount of material. In terms of reader stripe height and writer break point, the OSL process can target one bar-averaged reader stripe height and one bar-averaged writer break point per row bar of sliders. In other words one tilt setting for every row bar. The AKL process may not remove enough material to impact this bar-averaged reader-to-writer setting, but may remove enough material for within-bar actuation. Within-bar actuation means that the lapping of each head along a row bar can be different through voice coil push/pull forces, though for a given head the reader and writer may both be lapped for the same amount meaning the tilt between reader and writer tends to be constant and unaffected throughout the row bar.

There is a desire to target both the reader and the writer of each slider in a row bar during lapping, and with increasingly tighter precision as advanced designs require tighter reader stripe height (RSH) and writer break point (WBP) tolerances.

According to the present disclosure, one or more lasers (e.g., an array of lasers) can be used to focus on a particular structure of a slider (e.g., in a row bar) so as to heat up one or more structures on and/or within the slider and cause expansion (protrusion) of one or more structures at a desired time such as during lapping so as to selectively control the impact of lapping on a writer and/or reader of a slider. In some embodiments, a laser can cause the writer to protrude more than the reader in a given slider during lapping to independently control (set) WBP and RSH of the slider, thereby affecting within-bar tilt. In some embodiments, material removal of each writer and/or reader of each slider in a row bar can be selectively controlled as compared to the other writers and/or readers within the row bar. In some embodiments, a laser can cause the reader to protrude more than the writer in a given slider during lapping.

Figure 3C:
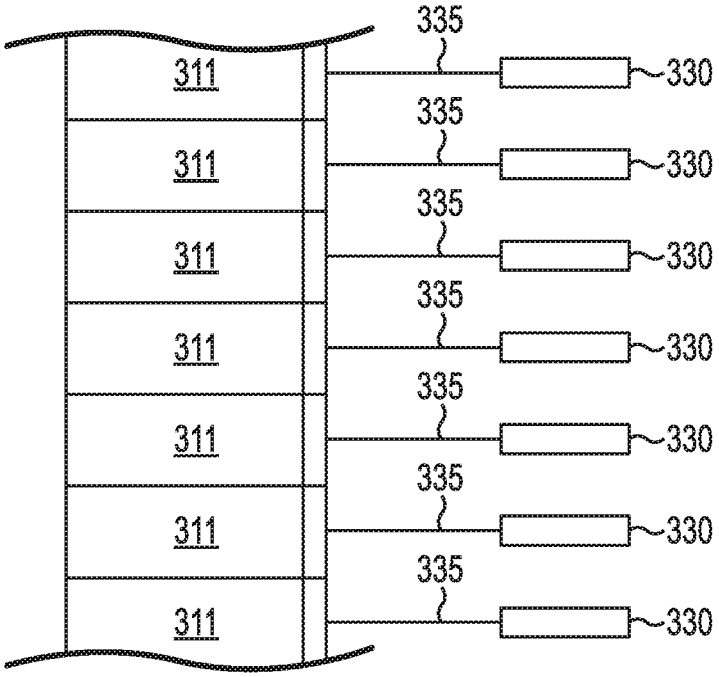
FIG. 3C is a partial, top view of the system shown in FIG. 3A with several components removed.

An example of using one or more lasers according to the present disclosure is illustrated with respect to FIGS. 3A, 3B, and 3C. A lapping system according to the present disclosure can include one or more laser components. As shown in FIG. 3C, system 300 includes a laser structure 330 for each slider 311 in row bar 310. As shown, laser components 330 are mounted on the mounting structure 305. Alternatively, one or more laser components 330 could be mounted a structure separate from mounting structure 305. Whether a laser components are mounted on mounting structure 305 or another structure, each laser component 330 can be, if desired, focused on relatively different locations for each slider 311 to generate different protrusion shapes. Advantageously, relatively larger, more robust external laser components 330 can be used since they are external to the slider 311 and are dedicated to being used during the manufacture of the slider (during lapping).

The position of one or more laser components 330 can be selected as desired and independent of a bar/slider, thereby making this approach suitable for any head design. In some embodiments, the position of a laser component 330 can be selected to control the protrusion of a writer during lapping to adjust the amount (e.g., increase the amount) that a writer is lapped on an individual slider basis. For example, as shown, each laser component 330 can be positioned to direct laser energy 335, when energized, to an area 340 of each slider body 311 to cause at least the write pole 314 to protrude toward the lapping surface 320 during at least a portion of the lapping. In more detail, FIG. 3B shows an enlarged view of transducer region 313. As used herein, the direction along x-axis is referred to as the cross-track axis. The direction along the z-axis is referred to herein as the down-track axis. The direction along the y-axis is referred herein as the lapping direction (direction of material removal) or the reader stripe height direction and writer break-point direction.

As shown in FIG. 3B, by causing the write pole 314 to protrude toward the lapping surface relative to one or more other positions of air bearing surface 312, more material can be removed from write pole 314 during lapping relative to the one or more other positions. In some embodiments, the laser energy 335 can cause the write pole 314 to protrude at least 1 nanometer as compared to when the laser energy 335 is not directed to the area 340, at least 3 nanometers as compared to when the laser energy 335 is not directed to the area 340, at least 5 nanometers as compared to when the laser energy 335 is not directed to the area 340, at least 10 nanometers as compared to when the laser energy 335 is not directed to the area 340, at least 20 nanometers as compared to when the laser energy 335 is not directed to the area 340, or even at least at least 30 nanometers as compared to when the laser energy 335 is not directed to the area 340. In some embodiments, the laser energy 335 can cause the write pole 314 to protrude less than 100 nanometers as compared to when the laser energy 335 is not directed to the area 340. As shown in FIG. 3B, when laser energy 335 is not directed to area 340, the "bottom" end of write pole 314 before lapping would be coplanar with reference line 320, which is coplanar with air bearing surface 312 that is shown to the right of AlTiC break 350. The amount of write pole 314 protrusion is illustrated in FIG. 3B by 317. After lapping and when the laser energy is not directed to area 340 (e.g., when the laser energy is turned off), the bottom surface of write pole 314 would then recede relative to reference line 320. The amount of write pole 314 recession is illustrated in FIG. 3B by 318.

In some embodiments, the write pole 314 protrudes further toward lapping plate surface 321 as compared to reader 315. For example, as shown in FIG. 3B, the laser energy 335 causes the write pole 314 and the reader 315 to protrude toward the lapping surface 321 during lapping. Because of where the laser energy is focused, the write pole 314 protrudes further from reference line 320 and toward lapping plate surface 321 as compared to reader 315. Because the write pole 314 protrudes further as compared to reader 315, more material can be removed from write pole 314 by lapping plate 320 during lapping as compared to material, if any, removed from reader 315. Because a single laser component 330 can control relative protrusion among write pole 314 and reader 315 for a single slider 311 in a row bar 310, another degree of freedom can be created for controlling the reader stripe height relative to writer break point during lapping of the row bar 310. If desired, a laser component 330 can be used for each individual slider 311 in a row bar 310. As shown in FIG. 3B, when laser energy 335 is not directed to area 340, the "bottom" end of reader 315 before lapping would be coplanar with reference line 320, which is coplanar with air bearing surface 312 that is shown to the right of AlTiC break 350. The amount of reader 315 protrusion is illustrated in FIG. 3B by 316. After lapping and when the laser energy is not directed to area 340 (e.g., when the laser energy is turned off), the bottom surface of reader 315 would then recede relative to reference line 320. The amount of reader 315 recession is illustrated in FIG. 3B by 319.

When using laser energy 335 to induce relative protrusion among write pole 314 and reader 315, the difference between the write pole 314 protrusion 317 and the reader 315 protrusion 316 can be at least 0.1 nanometers, at least 0.5 nanometers, at least 1 nanometer, or even at least 5 nanometers. In some embodiments, the difference between the write pole 314 protrusion 317 and the reader 315 protrusion 316 can be less than 10 nanonmeters.

Figure 5:
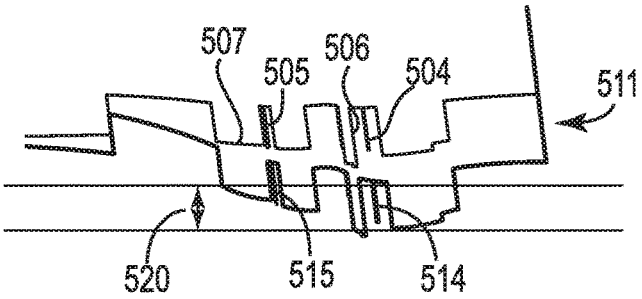
FIG. 5 is schematic drawing illustrating removal of additional writer material relative to reader material according to an embodiment of the present disclosure.

FIG. 5 shows an example illustrating the relative more protrusion of write pole 514 as compared to reader 515 when exposed to laser energy, and the corresponding additional amount 520 of write pole 514 that can be removed during lapping as compared to reader 515. Write pole 504 and reader 505 illustrate how the write pole 504 and reader 505 compare before being exposed to laser energy. FIG. 5 also shows reader electronic lapping guide 507 and write pole electronic lapping guide 506.

The laser energy from a laser component can be focused on a variety of areas of an individual slider in a row bar so as to cause the write pole to protrude toward the lapping plate during lapping, especially relative to other slider components such as the reader. In some embodiments, such an area can include one or more structures that can absorb laser energy and cause desired protrusion of the write pole. Such structures can be structures that are present in the slider body for other functions (e.g., coil 360) and/or can be other structures dedicated for absorbing laser energy and causing a desired protrusion profile. Such structures can be selected based on one or more factors such as their material and/or size so as to cause a desired protrusion profile when exposed to laser energy. An example of such a structure is a metal structure that can absorb laser energy, heat up, and expand in a direction at least toward the lapping plate. As shown in FIGS. 3A and 3B, laser energy 335 enters the trailing edge face 326 of a slider 311 and is transmitted through alumina, and absorbed in area 340, which includes coil 360. As shown, the trailing edge face 326 is adjacent to and shares the trailing edge with air bearing surface 312. Coil 360 can be made out of metal material such as CoFe or NiFe. The metal material in coil 360 can occupy a relatively large space in slider 311 and, therefore, function as a desirable target to absorb laser energy and heat up and expand and cause the write pole 314 to protrude. Write pole 314 may heat up and expand as well. An example of another metal structure in a slider body that can function as a desirable target to absorb laser energy and expand to cause a desirable protrusion profile is a reader shield. A variety of laser components 330 can be used according to the present disclosure. In some embodiments, a laser component can generate at least 5 milliWatts, at least 10 milliWatts, at least 20 milliWatts, at least 30 milliWatts, or even at least 50 milliWatts of laser energy that is directed to a slider. In some embodiments, a laser component can generate less than 500 milliWatts.

The laser energy delivered by a laser component to an area of a slider in a row bar can cause at least a portion of the area that the laser is focused on and that absorbs the laser energy to increase in temperature (e.g., from about 25° C.) by at least 5° C., at least 10° C., at least 20° C., at least 25° C., at least 30° C., at least 40° C., or even at least 50° C. In some embodiments, the laser energy delivered by a laser component to an area of a slider in a row bar can cause at least a portion of the area that the laser is focused on and that absorbs the laser energy to increase in temperature by not more than 100° C.

As shown in FIG. 3C, an array of laser components 330 are positioned such that each laser component 330 is dedicated to an individual slider 311 in row bar 310 so an area in the transducer region of each slider 311 can absorb laser energy and generate heat to cause the write pole to protrude toward the lapping plate. In some embodiments, 10 or more laser components, 30 or more laser components, 50 or more laser components, 70 or more laser components, etc. can be mounted on a lapping arm 306.

As described above, selecting an appropriate area of the transducer region to protrude toward the lapping plate can increase the contact pressure of the write pole on the lapping plate to increase the lapping rate (material removed/time) of the write pole relative to the reader. Although not required, if desired, using one or more laser components 330 as described herein can be combined with voice coil actuation to independently set both RSH and WBP of each slider 311 in row bar 310.

Figure 6:
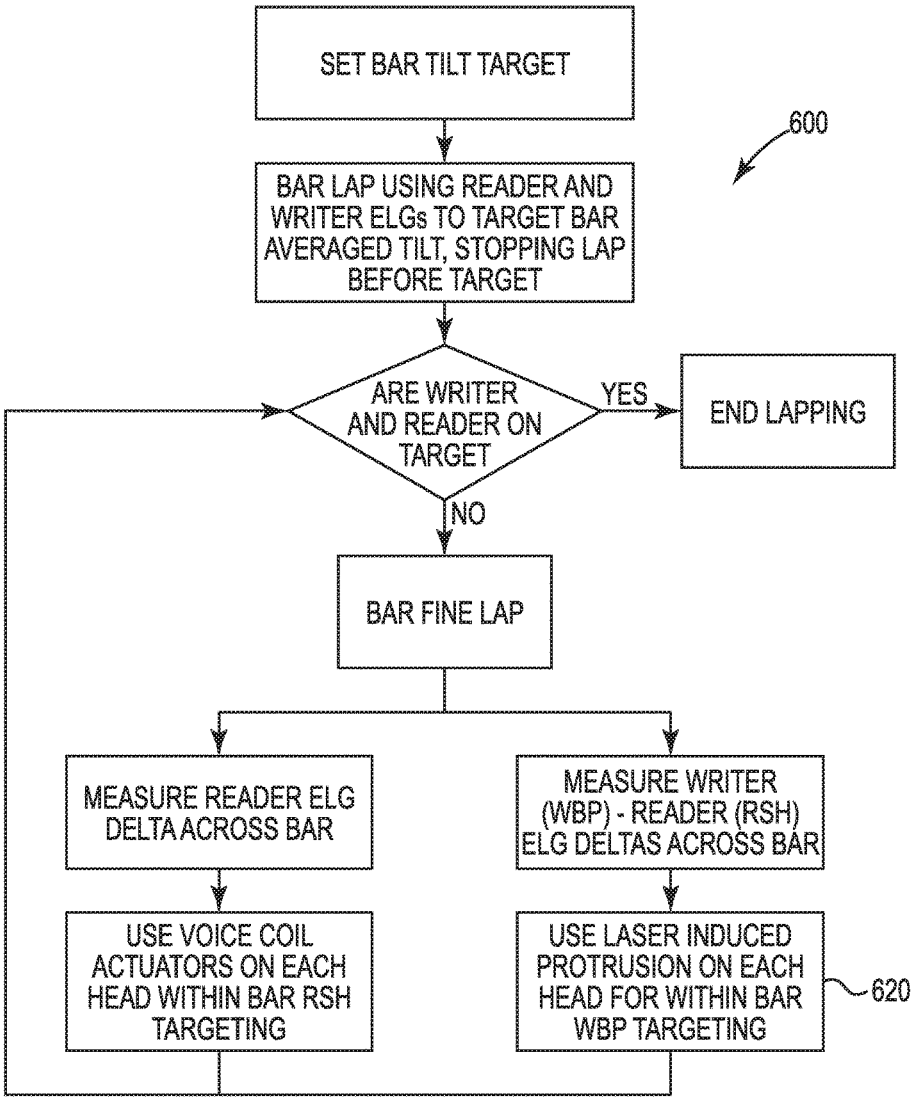
FIG. 6 shows a flow diagram illustrating a method according to an embodiment of the present disclosure.
Figure 7:
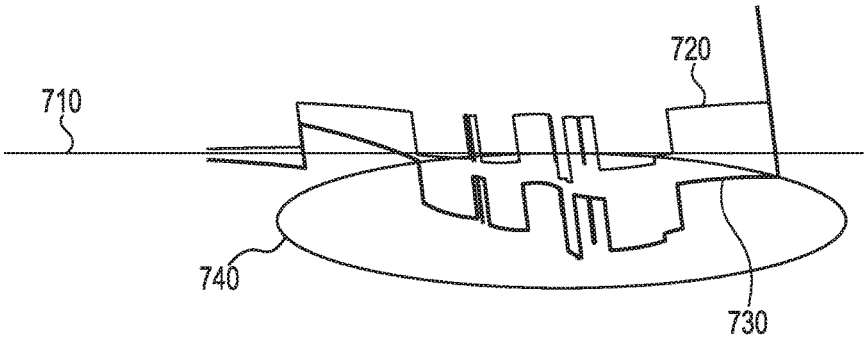
FIG. 7 is a schematic drawing illustrating removal of writer material and reader material according to the embodiment illustrated in FIG. 6.

FIG. 6 and FIG. 7 illustrate an exemplary embodiment according to the present disclosure. FIG. 6 illustrates an exemplary lapping protocol 600 and how laser energy according to the present disclosure could be incorporated into the protocol 600. FIG. 7 shows a lapping plate surface 710 relative to the bottom profile 720 of a slider that is not exposed to laser energy. Using laser energy according to the present disclosure, which is shown as step 620 in protocol 600, could cause the bottom profile of the slider to protrude as shown by profile 730 and cause an amount of material represented by circle 740 to be removed during lapping. While this may cause a "divot" in the bottom of the slider, it can still permit the advantage of relative protrusion of a write pole as compared to a reader.

Figure 8:
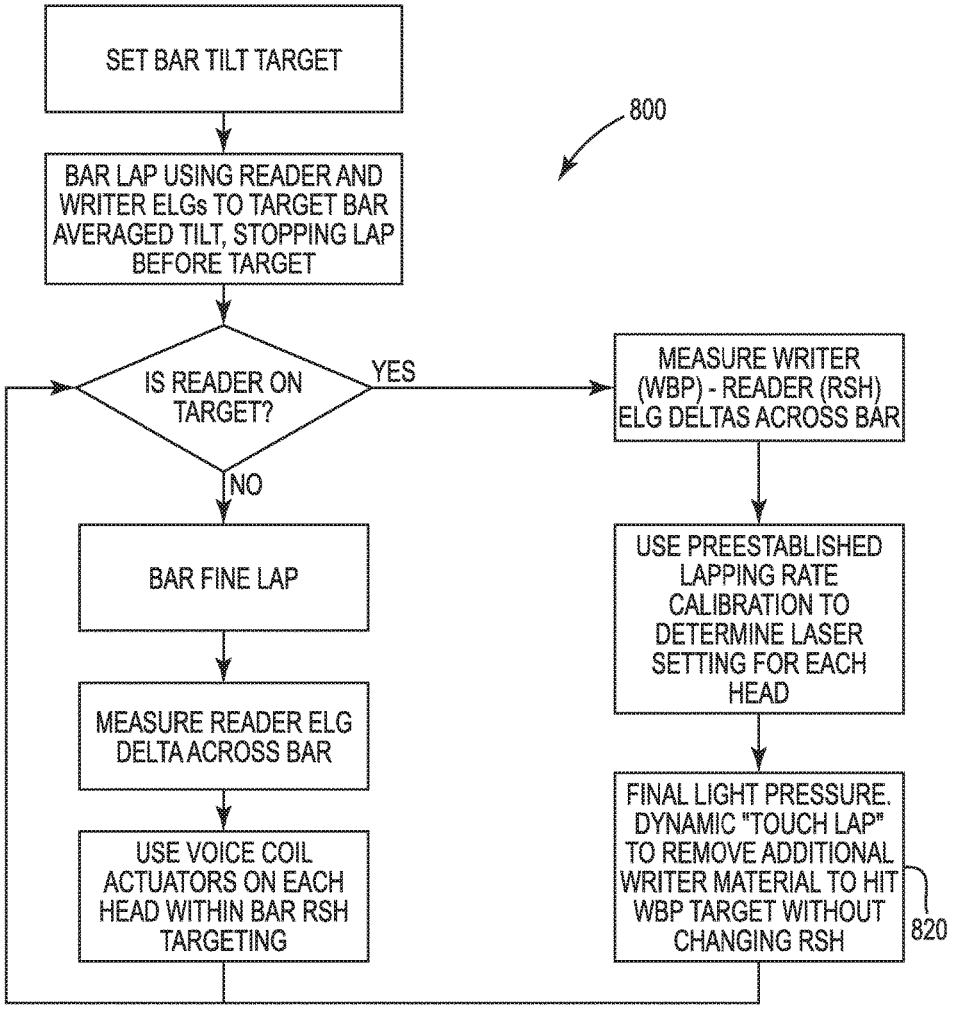
FIG. 8 shows a flow diagram illustrating a method according to an embodiment of the present disclosure.
Figure 9:
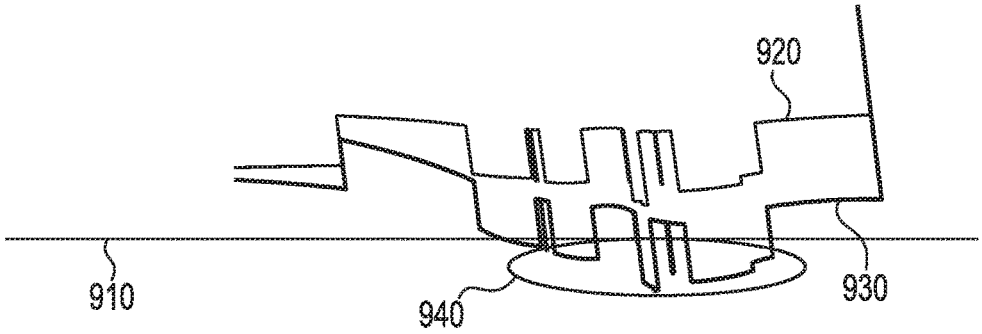
FIG. 9 is a schematic drawing illustrating removal of writer material and reader material according to the embodiment illustrated in FIG. 6.

FIG. 8 and FIG. 9 illustrate another exemplary embodiment according to the present disclosure. FIG. 8 illustrates an exemplary lapping protocol 800 and how laser energy according to the present disclosure could be incorporated into the protocol 800. FIG. 9 shows a lapping plate surface 910 relative to the bottom profile 920 of a slider that is not exposed to laser energy. Using laser energy according to the present disclosure, which is shown as step 820 in protocol 800, could cause the bottom profile of the slider to protrude as shown by profile 930 and cause an amount of material represented by circle 940 to be removed during lapping. While this may cause a "divot" in the bottom of the slider, it can still permit the advantage of relative protrusion of a write pole as compared to a reader. Further, the divot may be relatively smaller than the one described with respect to FIG. 7.

Modeling Performance

Figure 4:
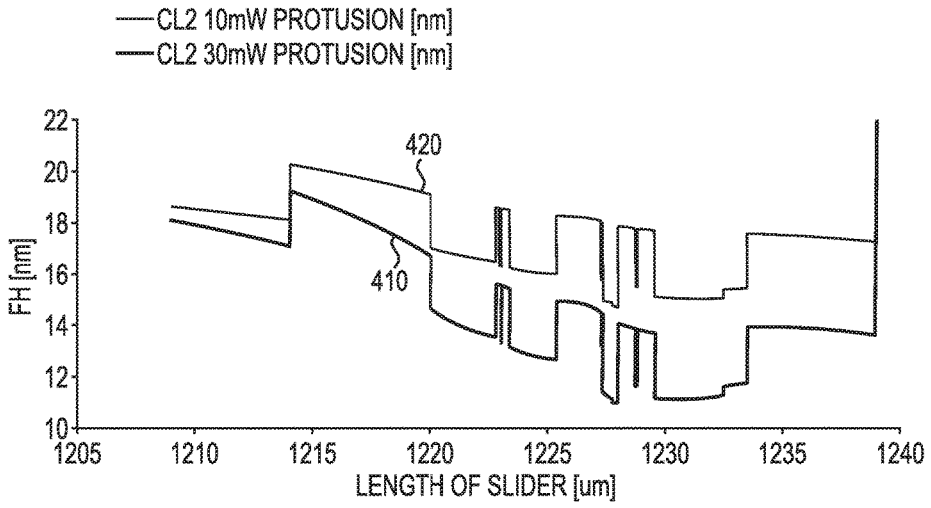
FIG. 4 is a graph of modeling data showing flying height (FH) versus length of slider.

Thermomechanical modeling was performed to predict how different wattage levels produced by an external laser could cause (via thermal expansion) a write pole to protrude relatively more than a reader according to the present disclosure. Such modeling is often used in the context of predicting slider fly height (FH) during read/write operations while "flying" over a rotating magnetic disc. For this simulation, the disc in the model is assumed to be a lapping plate. FIG. 4 is a graph representing results of a first simulation 410 and a second simulation 420 and shows fly height (FH) versus length of the slider in micrometers. As mentioned, while fly height can refer to the distance between an air bearing surface and a storage disc during read/write operations, the fly height in these simulations is used as a representation of the distance between an air bearing surface and the lapping surface of a lapping plate. The first simulation 410 (see FIG. 4) illustrated that 30 milliWatts of light absorption on a coil such as coil 360 can generate enough heat (and associated material expansion) to cause a write pole to protrude 1.8 nanometers more than a reader protrudes. In particular, the simulation showed that the write pole would protrude 10.3 nanometers and the reader would protrude 8.5 nanometers (for a difference of 1.8 nanometers). Also, the write pole would increase in temperature by about 30° C. due to absorbing the laser energy. This simulation shows that a write pole would protrude 1.8 nm relative to the reader due to 30 miLLiWatts of laser energy (or 0.06 nanometers per 1 milliWatt).

The second simulation 420 (see FIG. 4) illustrated that 10 milliWatts of light absorption on a coil such as coil 360 can generate enough heat (and associated material expansion) to cause a write pole to protrude 0.6 nanometers more than a reader protrudes. In particular, the simulation showed that the write pole would protrude 2.9 nanometers and the reader would protrude 2.3 nanometers (for a difference of 0.6 nanometers). Also, the write pole would increase in temperature by about 10° C. due to absorbing the laser energy. This simulation shows that a write pole would protrude 0.6 nm relative to the reader due to 10 milliWatts of laser energy (or 0.06 nanometers per 1 milliWatt).

What is claimed is:

1. A lapping system comprising:

a) a mounting structure that can removably couple a row bar comprising a plurality of slider bodies, wherein each slider body has an air bearing surface having a transducer region, wherein the transducer region comprises a write pole and a reader;

b) a lapping plate having a lapping surface that is operable to rotate and contact the row bar for lapping the write pole and the reader of each slider body; and c) one or more laser components, wherein each laser component is positioned to direct laser energy, when energized, to an area of an associated slider body to cause at least the write pole to protrude a greater distance relative to the reader toward the lapping surface during at least a portion of the lapping, or to cause at least the reader to protrude a greater distance relative to the write pole toward the lapping surface during at least a portion of the lapping.

2. The system of claim 1, wherein the mounting structure comprises;

a) an arm structure; and b) a carrier removably attached to the arm structure, wherein the row bar is removably attached to the carrier.

3. The system of claim 1, wherein the one or more laser components are mounted on the mounting structure.

4. A method of lapping comprising:

a) providing a row bar comprising a plurality of slider bodies, wherein each slider body has an air bearing surface having a transducer region, wherein the transducer region comprises a write pole and a reader;

b) lapping the row bar with a lapping surface of a rotating lapping plate to lap the write pole and the reader of each slider body; and c) during at least a portion of the lapping, directing laser energy to an area of at least one slider body to cause at least the write pole to protrude a greater distance relative to the reader toward the lapping surface, or to cause at least the reader to protrude a greater distance relative to the write pole toward the lapping surface.

5. The method of claim 4, wherein the laser energy causes the writer pole to protrude at least 1 nanometer as compared to when the laser energy is not directed to the area.

6. The method of claim 4, wherein the laser energy is at least 5 milliWatts.

7. The method of claim 4, wherein the laser energy causes the write pole to increase in temperature by at least 10° C.

8. The method of claim 4, wherein the laser energy causes the write pole and the reader to protrude toward the lapping surface during lapping, wherein the difference between the write pole protrusion and the reader protrusion is at least 0.1 nanometers.

9. The method of claim 8, wherein the difference between the write pole protrusion and the reader protrusion is at least 1 nanometer.

10. The method of claim 9, wherein the write pole protrusion is greater than the reader protrusion.

11. The method of claim 4, wherein the directing laser energy comprises directing laser energy from an independent laser component for each slider.

12. The method of claim 4, wherein directing laser energy to an area comprises directing laser energy to a writer coil.

13. The method of claim 4, wherein directing laser energy to an area comprises directing laser energy to a reader shield.

14. The method of claim 4, wherein the laser energy causes the write pole and the reader to protrude toward the lapping surface during lapping, wherein the difference between the write pole protrusion and the reader protrusion is at least 0.5 nanometers.

15. The method of claim 14, wherein the laser energy causes the write pole and the reader to protrude toward the lapping surface during lapping, wherein the difference between the write pole protrusion and the reader protrusion is less than 10 nanometers.

16. The method of claim 4, wherein the laser energy is at least 10 milliWatts.

17. The method of claim 4, wherein the laser energy is at least 20 milliWatts.

18. The system of claim 1, wherein the one or more laser components comprises a plurality of laser components.

19. A lapping system comprising:

a) a mounting structure that can removably couple a row bar comprising a plurality of slider bodies, wherein each slider body has an air bearing surface having a transducer region, wherein the transducer region comprises a write pole and a reader, wherein the mounting structure comprises;

i) an arm structure; and ii) a carrier removably attached to the arm structure, wherein the row bar is removably attached to the carrier;

b) a lapping plate having a lapping surface that is operable to rotate and contact the row bar for lapping the write pole and the reader of each slider body; and c) one or more laser components, wherein each laser component is positioned to direct laser energy, when energized, to an area of an associated slider body to cause at least one transducer device to protrude toward the lapping surface during at least a portion of the lapping, wherein the at least one transducer device is chosen from the write pole, the reader, and combinations thereof.

20. The system of claim 19, wherein the one or more laser components comprises a plurality of laser components.

* * * * *